US008273137B2

(12) United States Patent
Brewer et al.

(10) Patent No.: US 8,273,137 B2
(45) Date of Patent: Sep. 25, 2012

(54) FUEL COMPOSITION

(75) Inventors: Mark Lawrence Brewer, Chester (GB); Felix Balthasar, Hamburg (DE); Karsten Wilbrand, Hamburg (DE)

(73) Assignee: Shell Oil Company, Houston, TX (US)

( * ) Notice: Subject to any disclaimer, the term of this patent is extended or adjusted under 35 U.S.C. 154(b) by 255 days.

(21) Appl. No.: 12/350,779

(22) Filed: Jan. 8, 2009

(65) Prior Publication Data

US 2009/0178951 A1 Jul. 16, 2009

(30) Foreign Application Priority Data

Jan. 10, 2008 (EP) ..... 08100307

(51) Int. Cl.
*C10L 1/16* (2006.01)
*C10L 1/08* (2006.01)

(52) U.S. Cl. ..... 44/300; 44/388; 208/15; 208/20; 208/24; 585/9; 585/14

(58) Field of Classification Search ..... 44/300, 44/308; 208/15, 20, 21, 24; 585/9
See application file for complete search history.

(56) References Cited

U.S. PATENT DOCUMENTS

| | | | | |
|---|---|---|---|---|
| 4,019,878 | A | 4/1977 | Wisotsky | 44/62 |
| 4,208,190 | A | 6/1980 | Malec | 44/53 |
| 4,943,672 | A | 7/1990 | Hamner et al. | 585/737 |
| 5,059,299 | A | 10/1991 | Cody et al. | 208/27 |
| 5,490,864 | A | 2/1996 | Herbstman et al. | 44/379 |
| 6,187,065 | B1 * | 2/2001 | Jackson | 44/393 |
| 6,206,939 | B1 * | 3/2001 | Botros | 44/347 |
| 6,294,076 | B1 * | 9/2001 | Genetti et al. | 208/24 |
| 6,695,965 | B1 * | 2/2004 | Wittenbrink et al. | 208/27 |
| 6,846,848 | B2 * | 1/2005 | Wittenbrink et al. | 518/700 |
| 7,354,462 | B2 * | 4/2008 | O'Rear | 44/300 |
| 7,479,216 | B2 * | 1/2009 | Dieckmann et al. | 208/18 |
| 7,501,019 | B2 * | 3/2009 | Dieckmann et al. | 106/502 |
| 7,709,425 | B2 * | 5/2010 | Baralt et al. | 508/312 |
| 7,862,893 | B2 * | 1/2011 | O'Rear et al. | 428/403 |
| 7,875,166 | B2 * | 1/2011 | Matthai et al. | 208/24 |
| 7,951,759 | B2 * | 5/2011 | Dieckmann et al. | 508/450 |
| 2005/0138859 | A1 * | 6/2005 | Jackson et al. | 44/389 |
| 2006/0065573 | A1 | 3/2006 | Dieckmann et al. | 208/21 |
| 2006/0118462 | A1 * | 6/2006 | Schulze-Trautmann et al. | 208/20 |
| 2006/0219597 | A1 | 10/2006 | Bishop et al. | 208/15 |
| 2007/0243381 | A1 * | 10/2007 | O'Rear et al. | 428/403 |
| 2008/0052984 | A1 * | 3/2008 | O'Rear | 44/389 |
| 2008/0194761 | A1 * | 8/2008 | Van Bergen et al. | 524/606 |
| 2009/0158639 | A1 * | 6/2009 | Null | 44/308 |

FOREIGN PATENT DOCUMENTS

| | | | |
|---|---|---|---|
| AU | 698391 | | 10/1998 |
| EP | 147240 | | 7/1985 |
| EP | 239320 | | 9/1987 |
| EP | 0 255 345 | * | 2/1988 |
| EP | 255345 | | 2/1988 |
| EP | 0 308 176 | * | 3/1989 |
| EP | 308176 | | 3/1989 |
| EP | 482253 | | 4/1992 |
| EP | 583836 | | 2/1994 |
| EP | 613938 | | 9/1994 |
| EP | 668342 | | 8/1995 |
| EP | 776959 | | 6/1997 |
| EP | 1314771 | | 5/2003 |
| GB | 960493 | | 6/1964 |
| WO | WO9306194 | | 4/1993 |
| WO | WO9523200 | | 8/1995 |
| WO | WO9533805 | | 12/1995 |
| WO | WO9801516 | | 1/1998 |
| WO | WO9842808 | | 10/1998 |
| WO | WO9920720 | | 4/1999 |
| WO | WO9934917 | | 7/1999 |
| WO | WO0011118 | | 3/2000 |
| WO | WO02070630 | | 9/2002 |
| WO | WO2006056578 | | 6/2006 |
| WO | WO2006130219 | | 12/2006 |

OTHER PUBLICATIONS van der Burgt et al, "The Shell Middle Distillate Synthesis Process", paper delivered at the 5th Synfuels Worldwide Symposium, Washington DC, Nov. 1985.
van der Burgt et al, The Shell Middle Distillate Synthesis Process, paper delivered at the 5th Synfuels Worldwide Symposium, Washington DC, updated Nov. 1989.
Naidoo P., Watson M.D., 1994 Hot Melt Symposium, TAPPI Proceedings pp. 165-170.
The Markets for Shell Middle Distillate Synthesis Products, Presentation of Peter J.A. Tijm, Shell International Gas Ltd., Alternative Energy '95, Vancouver, Canada, May 2-4, 1995.
Danping Wei and H.A. Spikes, "The Lubricity of Diesel Fuels", Wear, III (1986) 217-235.

* cited by examiner

*Primary Examiner* — Ellen McAvoy

(57) ABSTRACT

A middle distillate fuel composition is provided comprising (a) a middle distillate base fuel, (b) a Fischer-Tropsch derived paraffinic wax component, and (c) one or more cold flow additives; a method for formulating a middle distillate fuel composition comprising a middle distillate base fuel, comprising (i) incorporating into the base fuel a Fischer-Tropsch derived wax component. The use of a Fischer-Tropsch derived wax component in a middle distillate fuel composition, for the purpose of increasing the effect of a CFPP improver additive in the composition is disclosed.

13 Claims, No Drawings

FUEL COMPOSITION

This application claims the benefit of European Application No. 08100307.1 filed Jan. 10, 2008.

FIELD OF THE INVENTION

The present invention relates to a middle distillate fuel composition and to its preparation and uses.

BACKGROUND OF THE INVENTION

With increasing legislative and environmental demands on middle distillate fuels, such as automotive gas oil (AGO) or industrial gas oil (IGO) and kerosene, it has been found increasingly difficult to meet the stringent cold flow properties, such as the cold filter plugging point (CFPP). In order to meet the most stringent legislative and environmental demands, Fischer-Tropsch derived middle distillates, with their inherent high quality will become more widely available within the next years. However, in spite of their outstanding quality, these middle distillates are known to suffer from poor cold flow properties due to high purity and high paraffin content, leading to the formation of wax crystals at relatively high temperatures. Furthermore, the addition of renewable fuels such as fatty acid methyl esters (FAME) and the high detergent dose rates associated therewith have been found to lead to a further decrease in the cold flow properties, specifically an increase in the cold filter plugging point. Accordingly, there is a need to be able to improve the response of middle distillate fuels to cold flow improvers.

EP-A-0308176 and EP-A-0255345 disclose the use of a mixture of n-paraffinic hydrocarbon waxes and a cold flow improver additive in mineral oil derived middle distillate fuel oils, e.g. heating oils and gas oil (diesel) fuels to give greater reductions in CFPP than the cold flow improver alone. However, the treat rates were rather high, even for mineral oil derived fuels, specifically if the wax content of the gas oil was taken into account.

SUMMARY OF THE INVENTION

Accordingly a middle distillate fuel composition comprising (a) a middle distillate base fuel, (b) a Fischer-Tropsch derived paraffinic wax component in the amount of at least 100 mg/kg and less than 3500 mg/kg, based on the fuel composition, and (c) one or more cold flow additives is provided.

A method of formulating a middle distillate fuel composition comprising a middle distillate base fuel, comprising (i) incorporating into the base fuel a Fischer-Tropsch derived wax component, in an amount effective to improve the cold flow properties of the mixture is also provided.

A method of operating a fuel consuming system using such composition is also provided.

DETAILED DESCRIPTION OF THE INVENTION

It has now been found that a significantly lower amount of a Fischer-Tropsch derived wax is not only highly soluble in the fuel composition at a low treat rate, but also significantly increases the cold flow response for a given cold flow improver additive treat rate, in particular in fuels that show only a limited response to standard cold flow improver additives. The addition of a Fischer-Tropsch derived wax improves filterability and cold flow properties.

Accordingly, the present invention relates to a middle distillate fuel composition comprising (a) a middle distillate base fuel, (b) a Fischer-Tropsch derived paraffinic wax component in the amount of at least 100 mg/kg and less than 3500 mg/kg, based on the fuel composition, and (c) one or more cold flow additives.

Preferably, said fuel composition further comprises an additive package.

In a further aspect, the present invention relates to a fuel composition according to the present invention, wherein the middle distillate base fuel comprises a Fischer-Tropsch derived middle distillate fraction.

Preferably, in said fuel composition, the middle distillate base fuel comprises a fatty acid methyl ester, a paraffinic hydrocracked fatty ester middle distillate fuel fraction, and/or a fatty ester middle distillate fuel fraction.

Preferably, the wax component (b) has a melting point in the range of from 40° C. to 120° C.

It has been found that the inclusion of a Fischer-Tropsch derived wax in a middle distillate fuel composition, in accordance with the present invention, can lead to an improvement in the cold flow properties of the composition, in particular a reduction in its cold filter plugging point (CFPP). This is particularly surprising since the wax components derived from a Fischer-Tropsch process comprise much heavier wax molecules that those disclosed in the prior art, as well as a significant amount of iso-paraffins.

This is even more surprising since the addition of the Fischer-Tropsch derived wax increased the cloud point in an almost linear fashion, while the cold filter plugging point was strongly reduced in the presence of a cold flow additive. Since the added wax comprises rather large amounts of higher paraffins, it might, therefore, have been expected to increase the CFPP of a fuel composition to which it is added.

The Fischer-Tropsch condensation process is a reaction which converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen to carbon monoxide ratios other than 2 to 1 may be employed if desired.

The carbon monoxide and hydrogen may themselves be derived from organic or inorganic, natural or synthetic sources, typically either from natural gas or from organically derived methane, or from coal, oil sands, or shale oil deposits and similar sources. In general the gases which are converted into liquid fuel components using Fischer-Tropsch processes can include natural gas (methane), LPG (e.g. propane or butane), "condensates" such as ethane, synthesis gas (carbon monoxide/hydrogen) and gaseous products derived from coal, biomass and other hydrocarbons. The Fischer-Tropsch process can be used to prepare a range of hydrocarbon fuels, including LPG, naphtha, kerosene and gas oil fractions. Of these, the gas oils have been used as, and in, automotive diesel fuel compositions, typically in blends with petroleum derived gas oils. The heavier fractions yield, following hydrotreating to remove any oxygenates and olefins, and optionally vacuum distillation, a series of hydrocarbon waxes having different composition of n- and iso-paraffins.

EP-A-0308176 and EP-A-0255345, as set out above, propose the use of blends of n-paraffinic hydrocarbon waxes having a carbon distribution between C20 and C44, together with specific cold flow improvers. It cannot however be predicted from such teachings that a Fischer-Tropsch derived hydrocarbon wax would be suitable, much less advantageous, for inclusion in a middle distillate fuel composition, in particular a diesel fuel composition such as an automotive diesel fuel composition.

Without wishing to be bound to any particular theory, it is believed that the effect of the addition of a Fischer-Tropsch derived wax on the response to cold flow improvers, independently from the actual carbon number distribution, is linked to the presence of iso-paraffins of the same carbon numbers in the hydrocarbon wax. This should reduce the crystallization tendency further, thereby reducing the CFPP temperature.

Moreover, the hydrocarbon waxes disclosed in EP-A-0308176 and EP-A-0255345 that show the most prominent effect are different to those according to the present invention, as will become apparent from the description below, indicating that the invention disclosed in the earlier document is likely to be based on different technical effects to those underlying the present invention.

In the context of the present invention, a Fischer-Tropsch derived hydrocarbon wax is suitably a wax which has been derived, whether directly or indirectly following one or more downstream processing steps, from a Fischer-Tropsch product. A Fischer-Tropsch product is the hydrocarbon product recovered from the Fischer-Tropsch derived feed stream after removal, for instance in one or more fractionation columns, usually a vacuum column, of gaseous and residual fractions.

In more general terms, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived fuel or fuel component will, therefore, be a hydrocarbon stream in which a substantial portion, except for added hydrogen, is derived directly or indirectly from a Fischer-Tropsch condensation process.

A Fischer-Tropsch derived product may also be referred to as a GTL (gas to liquids), BTL (biomass to liquids) or CTL (coal to liquids) product.

The initial boiling point of the Fischer-Tropsch product may be up to 400° C., but is preferably below 200° C. Preferably, any compounds having 4 or fewer carbon atoms and any compounds having a boiling point in that range are separated from a Fischer-Tropsch synthesis product before the Fischer-Tropsch synthesis product is used in said hydroisomerisation step. An example of a suitable Fischer-Tropsch process is described in WO-A-99/34917 and in AU-A-698391. The disclosed processes yield a Fischer-Tropsch product as described above.

The Fischer-Tropsch product can be obtained by well-known processes, for example the so-called Sasol process, the Shell Middle Distillate Synthesis process or the ExxonMobil "AGC-21" process. These and other processes are for example described in more detail in EP-A-0776959, EP-A-0668342, U.S. Pat. No. 4,943,672, U.S. Pat. No. 5,059,299, WO-A-99/34917 and WO-A-99/20720. The Fischer-Tropsch process will generally comprise a Fischer-Tropsch synthesis and a hydroisomerisation step, as described in these publications. The Fischer-Tropsch synthesis can be performed on synthesis gas prepared from any sort of hydrocarbonaceous material such as coal, natural gas or biological matter such as wood or hay.

Hydrocarbon products may be obtained directly from the Fischer-Tropsch reaction, or indirectly for instance by fractionation of Fischer-Tropsch synthesis products or from hydrotreated Fischer-Tropsch synthesis products.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4). An example of a Fischer-Tropsch based process is the SMDS (Shell Middle Distillate Synthesis) described in "The Shell Middle Distillate Synthesis Process", van der Burgt et al, paper delivered at the 5th Synfuels Worldwide Symposium, Washington D.C., November 1985; see also the November 1989 publication of the same title from Shell International Petroleum Company Ltd, London, UK. This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils useable in diesel fuel compositions, as well as hydrocarbon waxes.

The preparation of hydrocarbon wax fractions from the product obtained from the Fischer-Tropsch process is, for example, described in Naidoo P., Watson M.D., "*Manufacturing and quality aspects of producing hard waxes from natural gas and the resulting HMA performance obtained when using such a wax*", 1994 Hot Melt Symposium, TAPPI Proceedings, pages 165 to 170.

The Fischer-Tropsch derived wax component (b) used in the present invention is preferably separated as a fraction from the hydrocarbons produced during a Fischer-Tropsch synthesis reaction, and subsequent hydrotreating. The synthesis product as directly obtained in the Fischer-Tropsch process is preferably hydrogenated in order to remove any oxygenates and saturate any olefinic compounds present in such a product. Such a hydrotreatment is described in for example EP-A-0668342. The feed for the present product can be obtained by separating the lower boiling compounds and higher boiling compounds from the Fischer-Tropsch product by means of distillation or any other suitably separation technique.

An example of a commercially available Fischer-Tropsch derived wax as used in the present invention is 'Sarawax' grade 'SX50' as described in "*The Markets for Shell Middle Distillate Synthesis Products*", presentation of Peter J. A. Tijm, Shell International Gas Ltd., Alternative Energy '95, Vancouver, Canada, May 2-4, 1995. A version of the SMDS process, utilising a fixed bed reactor for the catalytic conversion step, is currently in use in Bintulu, Malaysia.

By virtue of the Fischer-Tropsch process, a Fischer-Tropsch derived product has essentially no, or undetectable levels of, sulphur and nitrogen. Compounds containing these heteroatoms tend to act as poisons for Fischer-Tropsch catalysts and are, therefore, removed from the synthesis gas feed. This can bring additional benefits to fuel compositions in accordance with the present invention.

Further, the Fischer-Tropsch process as usually operated produces no or virtually no aromatic components. The aromatics content of a Fischer-Tropsch derived fuel component, suitably determined by ASTM D-4629, will typically be below 1 wt %, preferably below 0.5 wt % and more preferably below 0.1 wt % on the total product.

Generally speaking, Fischer-Tropsch derived hydrocarbon products have relatively low levels of polar components, in particular polar surfactants, for instance compared to petroleum derived products. This may contribute to improved anti-foaming and dehazing performance. Such polar components may include, for example, oxygenates, and sulphur and nitrogen containing compounds. A low level of sulphur in a Fischer-Tropsch derived products is generally indicative of low levels of both oxygenates and nitrogen containing compounds, since all are removed by the same treatment processes.

A middle distillate fuel composition according to the present invention may be, for example, a naphtha, kerosene or diesel fuel composition. It may be a heating oil, an industrial gas oil, a drilling oil, an automotive diesel fuel, a distillate marine fuel or a kerosene fuel such as an aviation fuel or heating kerosene. It may in particular be a diesel fuel composition. Preferably, it is for use in an engine such as an automotive engine or an aeroplane engine. More preferably, it is suitable and/or adapted and/or intended for use in an internal combustion engine; yet more preferably it is an automotive fuel composition, still more preferably a diesel fuel composition which is suitable and/or adapted and/or intended for use in an automotive diesel (compression ignition) engine.

The fuel composition may in particular be adapted for, and/or intended for, use in colder climates and/or during colder seasons (for example, it may be a so-called "winter fuel").

The component (a) is a middle distillate base fuel, which may, in general, be any suitable liquid hydrocarbon middle distillate fuel oil. It may be organically or synthetically derived. It is suitably a diesel base fuel, for example a petroleum derived or Fischer-Tropsch derived gas oil.

A middle distillate base fuel will typically have boiling points within the usual diesel range of from 125 or 150 to 400 or 550° C., depending on grade and use. It will typically have a density from 0.75 to 1.0 g/cm$^3$, preferably from 0.8 to 0.86 g/cm$^3$, at 15° C. (IP 365) and a measured cetane number (ASTM D613) of from 35 to 80, more preferably from 40 to 75 or 70. Its initial boiling point will suitably be in the range 150 to 230° C. and its final boiling point in the range 290 to 400° C. Its kinematic viscosity at 40° C. (ASTM D445) might suitably be from 1.5 to 4.5 mm$^2$/s (centistokes). However, a diesel fuel composition according to the present invention may contain fuel components with properties outside of these ranges, since the properties of an overall blend may differ, often significantly, from those of its individual constituents.

Kinematic viscosities described in this specification were determined according to ASTM D-445. The boiling range distributions were measured according to ASTM D-86. "Cloud point" refers to the temperature at which a sample begins to develop a haze, as determined according to ASTM D-5773.

The base fuel component (a) used in a composition according to the present invention may itself be, or at least preferably comprise a Fischer-Tropsch derived fuel component, in particular a Fischer-Tropsch derived gas oil. Such fuels are known and in use in automotive diesel and other middle distillate fuel compositions. They are, or are prepared from, the synthesis products of a Fischer-Tropsch condensation reaction, as described above.

The base fuel component (a) may also comprise at least in part a petroleum derived gas oil. Such a gas oil may be obtained by refining and optionally (hydro) processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally, a petroleum derived gas oil may comprise some petroleum derived kerosene fraction. Such gas oils may be processed in a hydrodesulphurisation (HDS) unit so as to reduce their sulphur content to a level suitable for inclusion in a diesel fuel composition.

The base fuel component (a) according to the present invention may further comprise a mixture of two or more middle distillate, in particular diesel, fuel components of the types described above. It may be or contain a so-called "biodiesel" fuel component such as a vegetable oil or vegetable oil derivative (e.g. a fatty acid ester, in particular a fatty acid methyl ester) or another oxygenate such as an acid, ketone or ester. Such components need not necessarily be bio-derived.

The base fuel component (a) itself will suitably contain a major proportion of the middle distillate base fuel. A "major proportion" means typically 95 vol % or greater, more suitably 96 vol % or greater, most preferably 98 vol % or greater.

Preferably, wax component (b) used in a fuel composition according to the present invention comprises at least 97 wt % paraffin molecules. Preferably, the Fischer-Tropsch wax component (b) comprises more than 99 wt % of saturated, paraffinic hydrocarbons. Preferably at least 50 wt %, more preferably more than 55 wt %, more preferably more than 60 wt %, more preferably more than 70 wt %, more preferably more than 75 wt %, more preferably more than 85 wt %, more preferably at least 90 wt % of these paraffinic hydrocarbon molecules are n-paraffinic. Preferably, at least 3 wt %, more preferably at least 5 wt %, and more preferably at least 8 wt % of these paraffinic hydrocarbon molecules are iso-paraffinic. Preferably, at least 95 wt % of the saturated, paraffinic hydrocarbons are non-cyclic hydrocarbons. Naphthenic compounds (paraffinic cyclic hydrocarbons) are preferably present in an amount of not more than 1 wt %, more preferably less than 0.5 wt %.

The Fischer-Tropsch derived wax component (b) contains hydrocarbon molecules having consecutive numbers of carbon atoms, such that it comprises a continuous series of consecutive paraffins, i.e. paraffins having n, n+1, n+2, n+3 and n+4 carbon atoms. This series is a consequence of the Fischer-Tropsch hydrocarbon synthesis reaction from which the wax derives.

The wax component (b) preferably will be a solid under ambient conditions, at 25° C. and one atmosphere (101 kPa) absolute pressure.

The wax component (b) preferably has a congealing point in the range of from 30° C. to 120° C. (as determined according to ASTM D938), preferably of from 35° C. to 100° C., more preferably from 40° C. to 80° C.

The wax component (b) preferably comprises from 15 to 50 carbon atoms, more preferably from 16 to 48 carbon atoms, more preferably from 17 to 45 carbon atoms, more preferably from 18 to 42 carbon atoms, and most preferably from 19 to 38 carbon atoms. Component (b) preferably has an initial boiling point of at least 300° C. More preferably, its initial boiling point is at least 320° C., yet more preferably at least 350° C. The initial and end boiling point values referred to herein are nominal and refer to the T5 and T95 cut-points (boiling temperatures) obtained according to ASTM D-86.

Since conventional petroleum derived hydrocarbons and Fischer-Tropsch derived hydrocarbons comprise a mixture of varying molecular weight components having a wide boiling range, this disclosure will refer to the 10 vol % recovery point and the 90 vol % recovery point of the respective boiling ranges. The 10 vol % recovery point refers to that temperature at which 10 vol % of the hydrocarbons present within that cut will vaporise at atmospheric pressure, and could thus be recovered. Similarly, the 90 vol % recovery point refers to the temperature at which 90 vol % of the hydrocarbons present will vaporise at atmospheric pressure. When referring to a boiling range distribution, the boiling range between the 10 vol % and 90 vol % recovery boiling points is referred to in this specification.

Preferably, component (b) as well as a Fischer-Tropsch derived middle distillate comprises sulphur, nitrogen and metals in the form of hydrocarbon compounds containing them, in amounts of less than 50 ppmw (parts per million by weight), more preferably less than 20 ppmw, yet more preferably less than 10 ppmw. Most preferably, it will comprise sulphur and nitrogen at levels generally below the detection limits, which are currently 5 ppmw for sulphur and 1 ppmw for nitrogen when using, for instance, X-ray or 'Antek' Nitrogen tests for determination. However, sulphur may be introduced through the use of sulphided hydrocracking/hydrodewaxing and/or sulphided catalytic dewaxing catalysts.

Preferably, the wax component (b) is a distillate fraction obtained from a Fischer-Tropsch derived wax or waxy raffinate feed by:

(a) hydrogenating a Fischer-Tropsch derived feed, wherein at least 20 wt % of compounds in the Fischer-Tropsch derived feed have at least 30 carbon atoms;

(b) separating the product of step (a) into one or more distillate fraction(s).

The hydrogenation reaction of step (a) is preferably performed in the presence of hydrogen and a catalyst, which catalyst can be chosen from those known to one skilled in the art as being suitable for this reaction. Catalysts for use in hydrogenation typically comprise a hydrogenation-dehydrogenation functionality. Preferred hydrogenation-dehydrogenation functionalities are Group VIII metals, for example cobalt, nickel, palladium and platinum, more preferably platinum. In the case of platinum and palladium, the catalyst may comprise the hydrogenation-dehydrogenation active component in an amount of from 0.005 to 5 parts by weight, preferably from 0.02 to 2 parts by weight, per 100 parts by weight of carrier material. In case nickel is used, a higher content will typically be present, and optionally the nickel is used in combination with copper. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder preferably is non-acidic. Examples are clays and other binders known to one skilled in the art. In step (b), the product of step (a) is separated into one or more distillate fraction(s). This is conveniently done by performing one or more distillate separations on the effluent of the hydroisomerisation step to obtain at least one middle distillate fraction. Preferably, the effluent from step (a) is first subjected to an atmospheric distillation. The residue as obtained in such a distillation may in certain preferred embodiments be subjected to a further distillation performed at near vacuum conditions to arrive at a fraction having a higher 10 vol % recovery boiling point. The 10 vol % recovery boiling point of the residue may preferably vary between 300 and 450° C. This fraction may be subjected to an additional vacuum distillation suitably performed at a pressure of between 0.001 and 0.1 bar.

The wax component (b) may be used at a concentration of at least 0.01 wt % (100 mg/kg) and less than 0.35 wt % (3500 mg/kg) based on the resultant fuel composition. The minimum CFPP may appear at a different concentration for different Fischer-Tropsch derived waxes and/or middle distillate base fuels. It may for, example, be between 0.01 or 0.1 or 0.15 and 0.35 wt % based on the overall fuel composition. The concentration of the Fischer-Tropsch derived wax component (b) may be, for example, 0.1 or 0.2 wt % or greater. It may be 0.3 wt % or lower. All concentrations, unless otherwise stated, are quoted as percentages of the overall fuel composition. The concentration of the Fischer-Tropsch derived wax will generally be chosen to ensure that the density, viscosity, cetane number, calorific value and/or other relevant properties of the overall fuel composition are within the desired ranges, for instance within commercial or regulatory specifications. Suitable waxes include 'Sarawax' grades 'SX30', 'SX50' and 'SX70' (all commercially available from SMDS Malaysia, 'Sarawax' is a trade mark). Other suitable wax products include those disclosed as waxy raffinate or vacuum gas oil fraction as disclosed in EP-A-0583836, EP-A-0668342 and EP-A-1366136.

Preferably, the fuel composition according to the present invention contains one or more cold flow additives, for example flow improvers and/or wax anti-settling agents; such additives may be present at reduced concentrations due to the presence of the Fischer-Tropsch derived wax, as described below. A middle distillate fuel composition, particularly a fuel composition which is intended for use in colder climates and/or at colder times of the year, will usually include one or more cold flow additives so as to improve its performance and properties at lower temperatures. Known cold flow additives include middle distillate flow improvers and wax anti-settling additives. Since the present invention may be used to improve the cold flow properties of a fuel composition, it may also make possible the use of lower levels of such cold flow additives, and/or of other flow improver additives. In other words, inclusion of the Fischer-Tropsch derived wax potentially enables lower levels of cold flow and/or flow improver additives to be used in order to achieve a desired target level of cold flow performance from the overall composition.

A cold flow additive may be any material capable of improving the cold flow properties of the composition, as described above. A flow improver additive is a material capable of improving the ability or tendency of the composition to flow at any given temperature. A cold flow additive may, for example, be a middle distillate flow improver (MDFI) or a wax anti-settling additive (WASA) or a mixture thereof.

MDFIs may for example comprise vinyl ester-containing compounds such as vinyl acetate-containing compounds, in particular polymers. Copolymers of alkenes (for instance ethylene, propylene or styrene, more typically ethylene) and unsaturated esters (for instance vinyl carboxylates, typically vinyl acetate) are, for instance, known for use as MDFIs.

Other known cold flow additives (also referred to as cold flow improvers) include comb polymers (polymers having a plurality of hydrocarbyl group-containing branches pendant from a polymer backbone), polar nitrogen compounds including amides, amines and amine salts, hydrocarbon polymers and linear polyoxyalkylenes. Examples of such compounds are given in WO-A-95/33805, the disclosures of which are incorporated herein in their entirety, at pages 3 to 16 and in the examples.

Yet further examples of compounds useable as cold flow additives include those described in WO-A-95/23200, the disclosures of which are incorporated herein in their entirety. These include the comb polymers defined at pages 4 to 7 thereof, in particular those consisting of copolymers of vinyl acetate and alkyl-fumarate esters; and the additional low temperature flow improvers described at pages 8 to 19 thereof, such as linear oxygen-containing compounds, including alcohol alkoxylates (e.g. ethoxylates, propoxylates or butoxylates) and other esters and ethers; ethylene copolymers of unsaturated esters such as vinyl acetate or vinyl hexanoate; polar nitrogen containing materials such as phthalic acid amide or hydrogenated amines (in particular hydrogenated fatty acid amines); hydrocarbon polymers (in particular ethylene copolymers with other alpha-olefins such as propylene or styrene); sulphur carboxy compounds such as sulphonate salts of long chain amines, amine sulphones or amine carboxamides; and hydrocarbylated aromatics.

Such cold flow additives are conventionally included in diesel fuel compositions so as to improve their performance at lower temperatures, and thus to improve the low temperature operability of systems (typically vehicles) running on the compositions.

The (active matter) concentration of cold flow additive in a fuel composition prepared according to the present invention may be up to 1000 ppmw, preferably up to 500 ppmw, more preferably up to 400 or 300 ppmw. Its (active matter) concentration will suitably be at least 20 ppmw, preferably at least 30 or 50 ppm, more preferably at least 100 ppmw.

According to a further aspect, the present invention provides the use of a Fischer-Tropsch derived wax component in a middle distillate fuel composition, for the purpose of improving the responsiveness of the fuel to cold flow improvers, thus improving cold flow properties and/or the low temperature performance of the composition. The cold flow properties of a fuel composition can suitably be assessed by measuring its cold filter plugging point (CFPP), preferably using the standard test method IP 309 or an analogous technique. The CFPP of a fuel indicates the temperature at and below which wax in the fuel will cause severe restrictions to flow through a filter screen, and in the case of automotive diesel fuels, for example, can correlate with vehicle operability at lower temperatures. A reduction in CFPP will correspond to an improvement in cold flow properties, other things being equal. Improved cold flow properties in turn increase the range of climatic conditions or seasons in which a fuel can efficiently be used. An improvement in cold flow properties may be manifested by a reduction in, ideally suppression of, so-called "hesitation" effects which can occur in a CFPP test at temperatures higher than the CFPP value of a fuel. "Hesitation" may be understood as an at least partial obstruction of the CFPP test filter occurring at a temperature higher than the CFPP. Such an obstruction will be manifested—in a CFPP machine modified to allow such measurements—by an increased filtration time, albeit at a level below 60 seconds. If severe enough, hesitation causes the test to terminate early and the CFPP value to be recorded as the higher temperature—thus when hesitation occurs to a great enough extent, it is not recognised as hesitation but simply as a higher CFPP. References in this specification to CFPP values may generally be taken to include values which take account of—i.e. are raised as a result of—such hesitation effects. A reduction in hesitation effects may be manifested by complete elimination of a hesitation effect which would be observed when measuring the CFPP of the fuel composition without the Fischer-Tropsch derived wax present; and/or by a reduction in severity of such a hesitation effect (e.g. severe hesitation becomes only mild hesitation); and/or by a lowering of the temperature at which such a hesitation effect occurs. Since hesitation effects can cause variability in the measured CFPP of a fuel composition, in severe test machines triggering an increase in the recorded value, such a reduction may be beneficial because it can allow the CFPP of the composition to be more reliably and accurately measured, in turn allowing the composition to be more readily tailored to meet, and proven to meet, specifications such as industry or regulatory standards.

According to yet a further aspect, the present invention provides a method for formulating a middle distillate fuel composition comprising a middle distillate base fuel, optionally with other fuel components, the method comprising (i) incorporating into the base fuel a Fischer-Tropsch derived wax component, in an amount sufficient to improve the cold flow properties of the mixture. Step (i) may optionally be preceded by measuring the cold flow properties of the base fuel.

In the context of the present invention, "improving" the cold flow properties of the fuel composition embraces any degree of improvement compared to the performance of the composition before the Fischer-Tropsch derived wax is incorporated. This may, for example, involve adjusting the cold flow properties of the composition, by means of the wax, in order to meet a desired target, for instance a desired target CFPP value.

According to a further aspect of the present invention, the Fischer-Tropsch derived wax component (b) may be used for the dual purposes of improving the cold flow properties of the fuel composition and at the same time improving another property of the composition, for example increasing its cetane number or calorific value or viscosity, improving its lubricity, or changing the nature or level of emissions it causes during use in a fuel consuming system, in particular an automotive diesel engine. The wax may be used for the purpose of improving the acceleration and/or other measures of engine performance in an engine running on the fuel composition.

The present invention further provides use of a Fischer-Tropsch derived wax component in a middle distillate fuel composition, for the purpose of increasing the effect of a CFPP improver additive in the composition.

Accordingly, a further aspect of the present invention provides the use of a Fischer-Tropsch derived wax component in a middle distillate fuel composition, for the purpose of reducing the concentration of a cold flow or flow improver additive in the composition.

In the case, for example, of a diesel fuel composition intended for use in an automotive engine, a certain level of cold flow performance may be required in order for the composition to meet current fuel specifications, and/or to safeguard engine performance, and/or to satisfy consumer demand, in particular in colder climates or seasons. According to the present invention, such standards may still be achievable even with reduced levels of cold flow additives, due to the inclusion of the Fischer-Tropsch derived wax component.

In particular, where the fuel composition is an automotive diesel fuel composition, it will suitably comply with applicable standard specification(s) such as for example EN 590 (for Europe) or ASTM D-975 (for the USA). By way of example, the fuel composition may have a density from 0.82 to 0.845 g/cm$^3$ at 15° C.; a final boiling point (ASTM D86) of 360° C. or less; a cetane number (ASTM D613) of 51 or greater; a kinematic viscosity (ASTM D445) from 2 to 4.5 mm$^2$/s (centistokes) at 40° C.; a sulphur content (ASTM D2622) of 350 ppmw or less; and/or an aromatics content (IP 391(mod)) of less than 11% m/m. Relevant specifications may, however, differ from country to country and from year to year, and may depend on the intended use of the fuel composition.

A fuel composition according to the present invention—in particular when it is an automotive diesel fuel composition—may contain other components in addition to the middle distillate base fuel and the Fischer-Tropsch derived wax component. Such components will typically be present in fuel additives. Examples are detergents; lubricity enhancers; dehazers, e.g. alkoxylated phenol formaldehyde polymers; anti-foaming agents (e.g., polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; anti-oxidants (e.g. phenolics such as 2,6-di-tert-butylphenol, or phenylenediamines such as N,N'-di-sec-butyl-p-phenylenediamine); metal deactivators; static dissipator additives; combustion improvers; and mixtures thereof.

Detergent-containing diesel fuel additives are known and commercially available. Such additives may be added to diesel fuel compositions at levels intended to reduce, remove, or slow the build up of engine deposits. Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

A middle distillate fuel composition, in particular a diesel fuel composition, preferably includes a lubricity enhancer, in particular when the fuel composition has a low (e.g. 500 ppmw or less) sulphur content. A fuel composition according to the present invention will preferably be, overall, a low or ultra low sulphur fuel composition, or a sulphur free fuel composition, for instance containing at most 500 ppmw, preferably no more than 350 ppmw, most preferably no more than 100 or 50 ppmw, or even 10 ppmw or less, of sulphur.

A lubricity enhancer is conveniently used at a concentration of less than 1000 ppmw, preferably from 50 to 1000 or from 100 to 1000 ppmw, more preferably from 50 to 500 ppmw. Suitable commercially available lubricity enhancers include ester- and acid-based additives. Other lubricity enhancers are described in the patent literature, in particular in connection with their use in low sulphur content diesel fuels, for example in: Danping Wei and H. A. Spikes, "*The Lubricity of Diesel Fuels*", Wear, III (1986) 217-235, WO-A-95/33805, U.S. Pat. No. 5,490,864 and WO-A-98/01516. It may also be preferred for the fuel composition to contain an anti-foaming agent, more preferably in combination with an anti-rust agent and/or a corrosion inhibitor and/or a lubricity enhancing additive. Unless otherwise stated, the concentration of each such additional component in the fuel composition is preferably up to 10000 ppmw, more preferably in the range from 0.1 to 1000 ppmw, advantageously from 0.1 to 300 ppmw, such as from 0.1 to 150 ppmw (all additive concentrations quoted in this specification refer, unless otherwise stated, to active matter concentrations by weight). The concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The concentration of any ignition improver present will preferably be 2600 ppmw or less, more preferably 2000 ppmw or less, conveniently from 300 to 1500 ppmw.

If desired, one or more additive components, such as those listed above, may be co-mixed—preferably together with suitable diluent(s)—in an additive concentrate, and the additive concentrate may then be dispersed into the base fuel, or into the base fuel/wax blend, in order to prepare a fuel composition according to the present invention.

A diesel fuel additive may, for example, contain a detergent, optionally together with other components as described above, and a diesel fuel-compatible diluent, for instance a non-polar hydrocarbon solvent such as toluene, xylene, white spirits and those sold by Shell companies under the trade mark "SHELLSOL", and/or a polar solvent such as an ester or in particular an alcohol, e.g. hexanol, 2-ethylhexanol, decanol, isotridecanol and alcohol mixtures, most preferably 2-ethylhexanol.

The Fischer-Tropsch derived wax component may, in accordance with the present invention, be incorporated into such an additive formulation. The total additive content in the fuel composition may suitably be from 50 to 10000 ppmw, preferably below 5000 ppmw.

Additives may be added at various stages during the production of a fuel composition; those added at the refinery, for example, might be selected from anti-static agents, pipeline drag reducers, flow improvers (e.g. ethylene/vinyl acetate copolymers or acrylate/maleic anhydride copolymers), lubricity enhancers, anti-oxidants and wax anti-settling agents. When carrying out the present invention, a base fuel may already contain such refinery additives. Other additives may be added downstream of the refinery.

In the context of further aspects of the present invention, "use" of a Fischer-Tropsch derived wax component in a fuel composition means incorporating the wax component into the composition, typically as a blend (i.e. a physical mixture) with one or more other fuel components (in particular the middle distillate base fuel) and optionally with one or more fuel additives. The Fischer-Tropsch derived wax component is conveniently incorporated before the composition is introduced into an internal combustion engine or other system which is to be run on the composition. Instead or in addition the use may involve running a fuel consuming system, such as an engine, on the fuel composition containing the Fischer-Tropsch derived wax component, typically by introducing the composition into a combustion chamber of the system. "Use" of a Fischer-Tropsch derived wax component may also embrace supplying such a wax component together with instructions for its use in a middle distillate fuel composition to achieve the purpose(s) of aspects of the present invention, for instance to achieve a desired target level of cold flow performance (e.g. a desired target CFPP value) and/or to reduce the concentration of a cold flow additive in the composition. The wax component may itself be supplied as a component of a formulation which is suitable for and/or intended for use as a fuel additive, in which case the wax component may be included in such a formulation for the purpose of influencing its effects on the cold flow properties of a middle distillate fuel composition. Thus, the Fischer-Tropsch derived wax component may be incorporated into an additive formulation or package along with one or more other fuel additives.

According to a yet further aspect of the present invention there is provided a process for the preparation of a middle distillate fuel composition with improved cold flow improver response, such as a composition according to the first aspect, which process involves blending a middle distillate (for example gas oil, whereby automotive gas oil usually is denominated as diesel, or kerosene) base fuel with a Fischer-Tropsch derived wax component as defined above. This process conveniently may comprise the steps of: (i) preparing a Fischer-Tropsch derived feed as set out hereinabove, and (ii) separating the product of step (a) into one or more distillate fraction(s) and a residual fraction; (iii) hydrogenating at least part of a distillate fraction to obtain a Fischer-Tropsch derived hydrocarbon wax fraction; (iv) hydrocracking/hydroisomerisating at least part of a distillate fraction obtained in step (ii); (v) separating the product of step (iv) into one or more gas oil fractions and a base oil precursor fraction; (vi) blending the wax fraction obtained in step (iii) and the gas oil fraction obtained in step (v) to obtain a gas oil fraction having an improved cold flow improver response.

The blending may be carried out for one or more of the purposes described above in connection with aspects of the present invention, in particular with respect to the cold flow properties of the resultant fuel composition.

A yet further aspect provides a method of operating a fuel consuming system, which method involves introducing into the system a fuel composition according to the present invention, and/or a fuel composition prepared in accordance with any one of the aspects described above. Again the fuel composition is preferably introduced for one or more of the purposes described in connection with the present invention. Thus, the system is preferably operated with the fuel composition for the purpose of improving the low temperature performance of the system.

The system may in particular be a domestic heating installation; stationary power source such as generator comprising an internal combustion engine, and/or a vehicle which is driven by an internal combustion engine, in which case the method involves introducing the relevant fuel composition into a combustion chamber of the engine. The engine is preferably a compression ignition (diesel) engine. Such a diesel engine may be of the direct injection type, for example of the rotary pump, in-line pump, unit pump, electronic unit injector or common rail type, or of the indirect injection type. It may be a heavy or a light duty diesel engine.

The following examples illustrate the properties of fuel compositions in accordance with the present invention, and assess the effects of Fischer-Tropsch derived wax on the cold flow performance of middle distillate, in this case diesel, fuel compositions.

EXAMPLES

Example 1

A Fischer-Tropsch derived wax was blended in a range of proportions with a petroleum derived low sulphur diesel base fuel A0 further comprising a cold flow additive.

The effect of the different wax concentrations on the cold filter plugging points (CFPPs) of the blends was measured using the standard test method IP 309. For each blend, CFPPs were measured in triplicate, using at least two out of three different machines.

The Fischer-Tropsch wax was a 'Sarawax' (SX) 50 grade (commercially obtainable from Shell MDS Malaysia, 'Sarawax' is a trade mark). Its composition is given in Table 1:

TABLE 1

| Carbon No. | Normal paraffins | Iso-paraffins | Total |
|---|---|---|---|
| C18 | 0.03 | — | 0.03 |
| C19 | 0.61 | 0.01 | 0.62 |
| C20 | 1.34 | 0.08 | 1.42 |
| C21 | 2.24 | 0.13 | 2.38 |
| C22 | 3.78 | 0.23 | 4.01 |
| C23 | 6.14 | 0.38 | 6.52 |
| C24 | 8.76 | 0.58 | 9.34 |

TABLE 1-continued

| Carbon No. | Normal paraffins | Iso-paraffins | Total |
|---|---|---|---|
| C25 | 11.35 | 0.77 | 12.12 |
| C26 | 12.41 | 0.93 | 13.34 |
| C27 | 11.34 | 0.92 | 12.25 |
| C28 | 9.55 | 0.80 | 10.34 |
| C29 | 7.68 | 0.64 | 8.32 |
| C30 | 5.87 | 0.51 | 6.38 |
| C31 | 4.31 | 0.34 | 4.65 |
| C32 | 2.95 | 0.20 | 3.15 |
| C33 | 2.01 | 0.15 | 2.16 |
| C34 | 1.24 | — | 1.24 |
| C35 | 0.73 | — | 0.73 |
| C36 | 0.43 | — | 0.43 |
| C37 | 0.25 | — | 0.25 |
| C38 | 0.14 | — | 0.14 |
| C39 | 0.08 | — | 0.08 |
| C40 | 0.05 | — | 0.05 |
| C41 | 0.03 | — | 0.03 |
| C42 | 0.02 | — | 0.02 |

(Carbon number range and n-paraffin/iso-paraffin content of 93.3% m were determined by IP156/ASTM D-1319).

The properties of the diesel base fuel A0 are shown in Table 2 below:

TABLE 2

| | Test method | A0 |
|---|---|---|
| Fuel property | | |
| Density @ 15° C. (kg/m$^3$) | IP 365 | 832.5 |
| CFPP (° C.) | IP 309 | −11 |
| Cloud point (° C.) | ASTM D-5773 | −7 |
| Kinematic viscosity @ 40° C. (mm$^2$/s (cSt)) | IP 71 | 1.5 |
| Cetane number (IQT) | IP498 | 54 |
| Composition | | |
| Hydrocarbons content (vol %) | IP 156/ASTM D-1319 | 99 |
| HPLC aromatics (wt %) | IP391 (mod) | 23 |

The fuel without any additives (A0) exhibited a cloud point of −7° C. and a CFPP of −11° C.

As cold flow additives, two middle distillate flow improvers (MDFIs), 'R591' (MDFI 1) and 'R309' (MDFI 2), both commercially available from Infineum, were employed. The addition of the MDFIs at the concentrations employed in the examples resulted in a CFPP decrease by 1° C., to −12° C., underlining that the base fuel employed has a poor responsiveness to MDFI treatment. A further reduction in the CFPP value required significant increases in the MDFI concentration, which is undesirable because of adverse effects on fuel properties and costs. Table 3 below shows the test matrix.

TABLE 3

| Fuel and MDFI | Wax Concentration in mg/kg | | | | | |
|---|---|---|---|---|---|---|
| Concentration | 0 | 1000 | 1500 | 2000 | 2500 | 3500 |
| A0 + 130 mg/kg MDFI 1 | A1 | A2 | A3 | A4 | A5 | A6 |
| A0 + 65 mg/kg MDFI 1 | B1 | B2 | B3 | B4 | B5 | B6 |
| A0 + 130 mg/kg MDFI 2 | C1 | C2 | C3 | C4 | C5 | C6 |

The following tests were carried out with the 18 blends shown in Table 3:

The CFPP values (in triplicate), were determined for each fuel composition. The data given below represents the average values.

Further, fuel compositions A0 to A6 were subjected to a true boiling point distillation measurement pursuant to ASTM D-86 to assess changes in the distillation profile due to the presence of the Fischer-Tropsch wax. Also the cloud point (CP) of fuel compositions A0 to A6 was determined. For compositions B1 to C6, it was assumed that the distillation profile and cloud point would follow that of the fuel compositions A1 to A6.

Table 4 illustrates the CFPP values achieved as a function of the Fischer-Tropsch wax concentration.

TABLE 4

| Sample No. | Fischer-Tropsch wax mg/kg | MDFI 1 mg/kg | MDFI 2 mg/kg | CFPP ° C. |
|---|---|---|---|---|
| A0 | 0 | — | — | −11 |
| A1 | 0 | 130 | — | −12 |
| A2 | 1000 | 130 | — | −17 |
| A3 | 1500 | 130 | — | −17 |
| A4 | 2000 | 130 | — | −17 |
| A5 | 2500 | 130 | — | −17 |
| A6 | 3500 | 130 | — | −10 |
| B1 | — | 65 | — | −12 |
| B2 | 1000 | 65 | — | −15 |
| B3 | 1500 | 65 | — | −16 |
| B4 | 2000 | 65 | — | −15 |
| B5 | 2500 | 65 | — | −15 |
| B6 | 3500 | 65 | — | −8 |
| C1 | — | — | 150 | −12 |
| C2 | 1000 | — | 150 | −15 |
| C3 | 1500 | — | 150 | −18 |
| C4 | 2000 | — | 150 | −18 |
| C5 | 2500 | — | 150 | −17 |
| C6 | 3500 | — | 150 | −16 |

No hesitation was observed with any of the samples. A decrease in CFPP could be seen with all three variations of additive treatment. Quite clearly there is an optimum concentration of Fischer-Tropsch wax for each MDFI beyond which the CFPP starts to rise. An optimum amount appeared to reside in the vicinity of 1500 ppmw of Fischer-Tropsch wax, which corresponds to a decrease in CFPP of about 6° C. While viscosity remained unaffected by the presence of the Fischer-Tropsch wax, the increasing wax content could be seen in the distillation profile, particularly in the increase of the final boiling point. This is shown in Table 5 below.

TABLE 5

| Sample | Cloud Point ° C. | IBP ° C. | 5% ° C. | 10% ° C. | 20% ° C. | 30% ° C. | 40% ° C. | 50% ° C. | 60% ° C. | 70% ° C. | 80% ° C. | 90% ° C. | 95% ° C. | FBP ° C. |
|---|---|---|---|---|---|---|---|---|---|---|---|---|---|---|
| A0 | −7 | 191.8 | 227.6 | 240.1 | 254.2 | 264.3 | 273.4 | 281.4 | 289.9 | 299.4 | 310.8 | 327.4 | 341.9 | 351.5 |
| A1 | −7 | 193.6 | 231.5 | 242.9 | 255.7 | 265.5 | 274.2 | 282.4 | 291.5 | 301.3 | 313.4 | 331.3 | 349.8 | 353.3 |
| A2 | −6 | 194.0 | 229.2 | 241.5 | 254.7 | 265.0 | 274.0 | 282.3 | 290.8 | 300.4 | 312.2 | 329.3 | 345.3 | 353.6 |
| A3 | −6 | 192.6 | 226.9 | 240.4 | 254.0 | 264.4 | 273.2 | 281.0 | 289.4 | 298.8 | 310.0 | 325.6 | 338.1 | 352.7 |
| A4 | −5 | 193.3 | 226.2 | 240.5 | 254.7 | 264.5 | 273.6 | 281.7 | 290.2 | 299.8 | 311.5 | 328.1 | 343.0 | 354.2 |
| A5 | −4 | 195.9 | 228.4 | 240.9 | 255.3 | 264.6 | 273.7 | 282.1 | 290.8 | 300.5 | 312.0 | 329.1 | 345.6 | 354.9 |
| A6 | −3 | 199.3 | 230.7 | 242.4 | 255.8 | 265.5 | 274.0 | 282.2 | 290.9 | 300.5 | 312.1 | 329.0 | 344.8 | 356.5 |

Since heneicosan ($C_{21}H_{44}$), the first paraffin present in the Fischer-Tropsch wax tested in considerable amounts has a boiling point well above 350° C., the effect on T 95 boiling point by adding small amounts of Fischer-Tropsch Wax can neglected.

The increasing wax content could also be seen in the changing cloud point, which is also depicted in Table 5.

The increase in cloud point appears a logical consequence of adding a Fischer-Tropsch wax. However, the decrease in CFPP is much more prominent than the increase in cloud point which allows the cold flow properties of the fuel to be significantly improved. Moreover, it shows that surprisingly cloud point and CFPP are not directly linked in this area, which illustrates the synergistic effect of the blends. The reduction in CFPP, due to inclusion of the Fischer-Tropsch derived wax, appears to be non-linear with increasing wax concentration.

The greatest effect in CFPP reduction at a given additive rate was seen at wax concentrations around 0.1 and 0.2 wt %, with a minimum CFPP value recorded for the blend containing 0.15 wt % of the wax.

Even at 0.35 wt % of wax, however, the blend had a significantly lower CFPP than that recorded for the diesel base fuel alone. These reductions in CFPP in turn demonstrate an improvement in the cold flow properties of the fuels.

The data are surprising, in that the wax has a relatively high melting point. Hence, one would generally expect that on blending it with a diesel base fuel, its residual haze would re-precipitate and cause an overall deterioration in CFPP. Based purely on linear blending rules, one would not, therefore, have expected such an improvement in CFPP values, due to inclusion of the exemplified proportions of the wax.

Example 2

Example 1 was repeated in part but using as the base fuel a Fischer-Tropsch derived gas oil D0. The properties of Fischer-Tropsch derived gas oil D0 are as shown in Table 6:

TABLE 6

| | Test method | D0 |
|---|---|---|
| Fuel property | | |
| Density @ 15° C. ($kg/m^3$) | IP 365 | 784.9 |
| CFPP (° C.) | IP 309 | 0 |
| Cloud point (° C.) | ASTM D-5773 | 1 |
| Kinematic viscosity @ 40° C. ($mm^2/s$ (cSt)) | IP 71 | 3.523 |
| Cetane number (IQT) | IP498 | 77.8 |

TABLE 6-continued

| | Test method | D0 |
|---|---|---|
| Composition | | |
| Hydrocarbons content (vol %) | IP 156/ASTM D-1319 | 99.9 |

TABLE 6-continued

| | Test method | D0 |
|---|---|---|
| HPLC aromatics (wt %) | IP391 (mod) | <0.1 |

The fuel without any additives (D0) exhibited a CFPP of 0° C.

The middle distillate flow improvers MDFI 1 and MDFI 2, employed in Example 1, were also employed in Example 2. The addition of the MDFIs at the concentrations employed in the examples resulted in a CFPP decrease by up to 2° C., to −2° C., underlining that the Fischer-Tropsch gas oil base fuel employed has a poor responsiveness to MDFI treatment.

Table 7 below shows the test matrix.

TABLE 7

| Fuel and MDFI | Wax Concentration in mg/kg | | | | | | |
|---|---|---|---|---|---|---|---|
| Concentration | 0 | 750 | 1250 | 1500 | 1750 | 2500 | 3500 |
| D0 + 200 mg/kg MDFI 2 | D1 | D2 | D3 | D4 | D5 | D6 | D7 |
| D0 + 400 mg/kg MDFI 2 | — | — | — | — | D8 | D9 | D10 |
| D0 + 130 mg/kg MDFI 1 | E1 | E2 | E3 | E4 | E5 | E6 | E7 |

Tests as described above in Example 1 were carried out with the 17 blends shown in Table 7:

Table 8 illustrates the CFPP values achieved as a function of the Fischer-Tropsch wax concentration.

TABLE 8

| Sample No. | Fischer-Tropsch wax mg/kg | MDFI 1 mg/kg | MDFI 2 mg/kg | CFPP ° C. |
|---|---|---|---|---|
| D0 | 0 | — | — | 0 |
| D1 | 0 | — | 200 | −2.00 |
| D2 | 750 | — | 200 | −3.00 |
| D3 | 1250 | — | 200 | −3.33 |
| D4 | 1500 | — | 200 | −3.33 |
| D5 | 1750 | — | 200 | −4.00 |
| D6 | 2500 | — | 200 | −4.33 |
| D7 | 3500 | — | 200 | −5.00 |
| D8 | 1750 | — | 400 | −4.00 |
| D9 | 2500 | — | 400 | −4.33 |
| D10 | 3500 | — | 400 | −4.67 |
| E1 | 0 | 130 | — | −1.67 |
| E2 | 750 | 130 | — | −2.67 |
| E3 | 1250 | 130 | — | −3.00 |
| E4 | 1500 | 130 | — | −3.00 |
| E5 | 1750 | 130 | — | −3.33 |
| E6 | 2500 | 130 | — | −4.00 |
| E7 | 3500 | 130 | — | −5.00 |

Example 3

Example 1 was repeated in part but using as the base fuel Fischer-Tropsch derived gas oil D0 blended with 10 vol % of a fatty acid methyl ester (FAME), namely rapeseed methyl ester (RME).

The properties of the blend GO of Fischer-Tropsch derived gas oil D0 and 10 vol % RME are as shown in Table 9:

TABLE 9

| Fuel property | Test method | G0 |
|---|---|---|
| Density @ 15° C. (kg/m$^3$) | IP 365 | 794.79 |
| CFPP (° C.) | IP 309 | −1.33 |
| Cloud point (° C.) | ASTM D-5773 | 0 |
| Kinematic viscosity @ 40° C. (mm$^2$/s (cSt)) | IP 71 | 3.580 |
| Cetane number (IQT) | IP498 | 77.2 |

The properties of the RME are as shown in Table 10:

TABLE 10

| Property | Units | Value |
|---|---|---|
| Ester content | % m/m | 98.2 |
| Density at 15° C. | kg/m$^3$ | 883.8 |
| Viscosity at 40° C. | mm$^2$/s | 4.5 |
| Oxidation stability, 110° C. | hours | 9.1 |

The blend G0 of Fischer-Tropsch derived base fuel D0 and RME without any additives exhibited a CFPP of −1.33° C.

The middle distillate flow improver MDFI 2, employed in Example 1, was also employed in Example 3. A further middle distillate flow improver 'R408' (MDFI 3), commercially available from Infineum, was also used.

Table 11 below shows the test matrix.

TABLE 11

| Fuel/RME blend and | Wax Concentration in mg/kg | | | |
|---|---|---|---|---|
| MDFI Concentration | 0 | 1500 | 2500 | 3500 |
| GO + 100 mg/kg MDFI 3 | G1 | G2 | G3 | G4 |
| G0 + 50 mg/kg MDFI 3 + 300 mg/kg MDFI 2 | G5 | G6 | G7 | G8 |

Tests as described above in Example 1 were carried out with the 8 blends shown in Table 11:

Table 12 illustrates the CFPP values achieved as a function of the Fischer-Tropsch wax concentration.

TABLE 12

| Sample No. | Fischer-Tropsch wax mg/kg | MDFI 2 mg/kg | MDFI 3 mg/kg | CFPP ° C. |
|---|---|---|---|---|
| G0 | 0 | — | — | −1.33 |
| G1 | 0 | — | 100 | −1.00 |
| G2 | 1500 | — | 100 | −2.00 |
| G3 | 2500 | — | 100 | −3.33 |
| G4 | 3500 | — | 100 | −2.67 |
| G5 | 0 | 300 | 50 | −4.00 |
| G6 | 1500 | 300 | 50 | −4.33 |
| G7 | 2500 | 300 | 50 | −6.33 |
| G8 | 3500 | 300 | 50 | −7.33 |

The above results illustrate the utility of the present invention in formulating improved diesel fuel compositions. The present invention may be used to improve the low temperature performance of a diesel fuel composition and/or to reduce the level of cold flow additives required in it. In addition, since Fischer-Tropsch derived fuel components are known to act as cetane improvers, the cetane number of the composition can be simultaneously increased.

The invention claimed is:

1. A middle distillate fuel composition comprising (a) a middle distillate base fuel, (b) a Fischer-Tropsch derived paraffinic wax component in the amount of at least 100 mg/kg and less than 3500 mg/kg, based on the fuel composition, having a melting point in the range of from 40° C. to 120° C., and at least 90 wt % of the paraffinic hydrocarbon molecules in the paraffinic wax are n-paraffinic, and (c) one or more cold flow additives in an amount up to 1000 ppmw, wherein the middle distillate base fuel comprises a fatty acid methyl ester, a paraffinic hydrocracked fatty ester middle distillate fuel fraction, and/or a fatty ester middle distillate fuel fraction.

2. The fuel composition of claim 1 further comprising an additive package.

3. The fuel composition of claim 1 wherein the middle distillate base fuel comprises a Fischer-Tropsch derived middle distillate fraction.

4. The fuel composition of claim 1 wherein the wax component (b) comprises hydrocarbons having a carbon range of from 16 to 48 carbon atoms.

5. The fuel composition of claim 1 wherein the wax component (b) has a congealing point as determined according to ASTM D938 in the range of from 40° C. to 80° C.

6. The fuel composition of claim 4 wherein the wax component (b) has a congealing point as determined according to ASTM D938 in the range of from 40° C. to 80° C.

7. A method of operating a fuel consuming system, involving introducing into the system a fuel composition of claim 1.

8. A method of operating a fuel consuming system, involving introducing into the system a fuel composition of claim 4.

9. The fuel composition of claim 1 wherein the Fischer-Tropsch derived wax component comprise more than 99 wt % saturated paraffinic hydrocarbons, said paraffinic hydrocarbons is at least 50 wt % n-paraffinic and at least 3 wt % iso-paraffinic.

10. The fuel composition of claim 9 wherein the Fischer-Tropsch derived wax component congealing point as determined according to ASTM D938 in the range of from 40° C. to 80° C.

11. The fuel composition of claim 1 where the amount of cold flow additive (c) is up to 500 ppmw.

12. A method for formulating a middle distillate fuel composition comprising a middle distillate base fuel and at least one cold flow additive, comprising (i) incorporating into a base fuel comprising a fatty acid methyl ester, a paraffinic hydrocracked fatty ester middle distillate fuel fraction, and/or a fatty ester middle distillate fuel fraction, a Fischer-Tropsch derived paraffinic wax component wherein at least 90 wt % of the paraffinic hydrocarbon molecules in the paraffinic wax are n-paraffinic, in an amount effective to improve the cold flow response of the fuel to the cold flow additive.

13. The method of claim 12 wherein the Fischer-Tropsch derived wax component is present in an amount of at least 100 mg/kg and less than 3500 mg/kg, based on the fuel composition.

* * * * *